US005569572A

United States Patent [19]

Laing et al.

[11] Patent Number: 5,569,572

[45] Date of Patent: Oct. 29, 1996

[54] PROCESSES FOR CONTROLLING DEVELOPER AGING

[75] Inventors: John R. Laing, Rochester; George W. Vianco, Walworth, both of N.Y.

[73] Assignee: Xerox Corporation, Stamford, Conn.

[21] Appl. No.: 573,808

[22] Filed: Dec. 18, 1995

[51] Int. Cl.[6] ..... G03G 9/08

[52] U.S. Cl. ..... 430/137

[58] Field of Search ..... 430/137

[56] References Cited

U.S. PATENT DOCUMENTS

| | | | |
|---|---|---|---|
| 4,298,672 | 11/1981 | Lu | 430/108 |
| 4,394,430 | 7/1983 | Jadwin et al. | 430/110 |
| 4,537,850 | 8/1985 | Smeiman | 430/137 |
| 4,560,635 | 12/1985 | Hoffend et al. | 430/106.6 |
| 4,828,956 | 5/1989 | Creatura et al. | 430/137 |
| 5,155,001 | 10/1992 | Landa et al. | 430/137 X |
| 5,370,962 | 12/1994 | Anderson et al. | 430/137 |

*Primary Examiner*—Roland Martin
*Attorney, Agent, or Firm*—E. O. Palazzo

[57] ABSTRACT

A process for the preparation of developer compositions comprising providing a first developer comprised of carrier and first toner comprised of resin, pigment, polyolefin, compatibilizer, charge control agent, and surface additive, and adding thereto a second replenisher comprised of carrier, and second toner comprised of resin, pigment, polyolefin, compatibilizer, charge control agent, and surface additive, and wherein the surface additive of the second toner is present in a lesser amount than the surface additive of the first toner.

24 Claims, No Drawings

PROCESSES FOR CONTROLLING DEVELOPER AGING

BACKGROUND OF THE INVENTION

The present invention is generally directed to toner and developer compositions, and more specifically, the present invention is directed to processes for controlling developer aging characteristics. In embodiments, the present invention relates to processes where the developer $A_t$ increases, that is for example where the $A_t$ transient is initially relatively low and increases to a stable value after usage, especially at constant toner concentrations. Moreover, in embodiments the process of the present invention enables a higher toner triboelectric charge and excellent toner yields, which toner yield is inversely dependent upon the developed mass, which is dependent on the toner tribo, and thus a higher toner tribo, for example equal to or greater than 20 microcoulombs per gram. With the processes of the present invention, the values of $A_t$ increased as indicated herein, as determined from the following calculation, that is the product of 3.5 plus the toner concentration (TC) multiplied by the charge Q/M.

$$A_t=(3.5+TC)Q/M$$

The desired $A_t$ developer tribo, and toner concentrations are, for example, in embodiments from about 120 to about 230 units for $A_t$, from about 12 to about 23 microcoulombs per gram for tribo (Q/M), and a toner concentration of from about 6 to about 10. The toner and developer compositions of the present invention in embodiments thereof possess excellent admix characteristics as indicated herein, and maintain their triboelectric charging characteristics and $A_t$ for an extended number of imaging cycles, exceeding, for example, it is believed, 50,000 in a number of embodiments. The toner and developer compositions of the present invention can be selected for electrophotographic, especially xerographic imaging and printing processes, including color processes.

Toner, developer compositions, and processes thereof are known. For example, there are illustrated in U.S. Pat. No. 4,338,390, the disclosure of which is totally incorporated herein by reference, developer compositions containing as charge enhancing additives organic sulfate and sulfonates, which additives can impart a positive charge to the toner composition comprised of resin and pigment. Further, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other patents disclosing positively charged toner compositions with charge control additives include U.S. Pat. Nos. 3,944,493; 4,007,293; 4,079,014, 4,394,430, and 4,560,635, which illustrates a toner with a distearyl dimethyl ammonium methyl sulfate charge additive.

Moreover, toner compositions with negative charge enhancing additives, and processes thereof are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. No. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives. These and other charge additives can be selected for the present invention, with P51, quaternary ammonium salt, at 0.5 to 2.0 percent, available from Orient Chemicals being preferred.

In U.S. Pat. No. 5,082,761, there is illustrated a set of toners comprised of an initial supply toner and a supplementary toner, both of which are comprised of toner powder and additives on the surface.

SUMMARY OF THE INVENTION

It is an object of the present invention to provide toner and developer compositions with charge enhancing additives.

In another object of the present invention there are provided processes for the preparation of developer compositions with a desirable $A_t$.

In yet another object of the present invention there are provided processes for the preparation of developer compositions with an increasing $A_t$ value, which when a certain $A_t$ is attained it remains at this value for an extended time period.

In yet another object of the present invention there are provided processes for the preparation of toner and developer compositions with an acceptable triboelectrical charge.

Also, in yet another object of the present invention there are provided processes for the preparation of toner compositions with a high stable triboelectrical charge of about 18 to about 24 microcoulombs per gram and wherein the admix is excellent, for example equal to or less than 15 seconds in embodiments.

Further, in another object of the present invention there are provided processes for the preparation of toner compositions with a desirable $A_t$ at certain toner concentrations, such as from about 6 to about 10 and preferably about 8 percent.

In yet a further object of the present invention there are provided humidity insensitive, from about, for example, 20 to 80 percent relative humidity at temperatures of from 60° to 80° F. as determined in a relative humidity testing chamber, positively charged toner compositions with desirable admix properties of 5 seconds to 60 seconds as determined by the charge spectrograph, and preferably less than 15 seconds for example, and more preferably from about 1 to about 14 seconds, and acceptable triboelectric charging characteristics of from about 15 to about 30 microcoulombs per gram.

Another object of the present invention resides in the formation of toners which will enable the development of images in electrophotographic imaging apparatuses, which images have substantially no background deposits thereon, are substantially smudge proof or smudge resistant, and therefore, are of excellent resolution; and further, such toner compositions can be selected for low to mid speed electrophotographic apparatuses, that is those with speeds of up to about 50 copies, and preferably about 14 copies per minute.

In another object of the present invention there are provided processes wherein the developer $A_t$ transient, which is initially relatively low, increases to a stable value, and wherein there is selected a higher amount of external additives on the blend or second toner as compared to the first toner, and wherein the initial triboelectric charge of the toner is decreased.

These and other objects of the present invention can be accomplished in embodiments thereof by providing toner compositions comprised of resin particles, and pigment particles, developer compositions thereof, and processes thereof. In embodiments, the present invention is directed to a process for the preparation of developer compositions comprising providing a first developer comprised of carrier and toner comprised of resin, pigment, a polyolefin, a polyolefin wax, compatibilizer, charge control agent, and surface additive, and adding thereto a second replenisher developer comprised of carrier, and toner comprised of resin, pigment, a polyolefin or polyolefin wax, compatibilizer, charge control agent, and surface additive, and wherein the surface additive of the second toner is present in a lesser amount than the surface additive of the first toner; a process for the preparation of developer compositions comprising providing a developer comprised of carrier and a first toner comprised of resin, pigment, polyolefins, compatibilizer, charge control agent, and surface additive, and adding thereto a second replenisher developer comprised of carrier, and toner comprised of resin, pigment, polyolefin, compatibilizer, charge control agent, and surface additive, and wherein the additive of the second toner is present in an amount of 0.1 to about 1.5 weight percent lower than the additive of the first toner; and a process for the preparation of developers comprised of adding to a first developer comprised of carrier with a magnetite core, available from Hoganaes Inc. of Sweden, with a polymeric coating, or a plurality of coatings thereover and a first toner as indicated hereinbefore, to a second developer comprised of carrier of magnetite with a polymeric coating thereover, or a plurality of coatings thereover, and a second toner as illustrated hereinbefore, and wherein the second toner contains a smaller, or lesser amount of surface additive like titanium dioxide than the first toner. In the embodiments, the additive of the second toner is present in an amount of from about 0.1 to about 1 and preferably about 0.25 weight percent less than the additive of the first toner. Thus, when the additive of the first toner is present in an amount of 2.0 weight percent, the additive of the second toner is present in an amount of 1.75 weight percent. Typically, the additive of the first toner is present in an amount of from about 1.5 to about 5 and preferably from about 1.75 to about 2.25 weight percent; and the additive for the second toner is present in an amount of from about 1.0 to about 5.0 and preferably from about 1.5 to about 2.0 weight percent.

The first and second toners contain polyolefins, compatibilizer, such as KRATON®, a copolymer, reference U.S. Pat. No. 5,229,242, the disclosure of which is totally incorporated herein by reference, and charge control agent, or charge enhancing additive. The pigment, such as carbon black, can be selected in various effective amounts such as from about 3 to about 9 weight percent, and typically from about 4 to about 7 weight percent; compatibilizer amount will range, for example, from about 0.5 to about 5 weight percent, and preferably or typically from about 1 to about 3 weight percent; polyolefin amount will range, for example, from about 3 to about 10, and typically from about 5 to about 8 weight percent; and the charge additive, such as a quaternary ammonium salt, amount will range from about 0.5 to about 3 and typically from about 0.5 to about 1.5 weight percent.

The toner compositions can be prepared by a number of known methods such as admixing and heating resin particles, such as styrene acrylate copolymers, pigment particles such as carbon black, in a toner extrusion device, such as the ZSK53 available from Werner Pfleiderer, and removing the formed toner composition from the device. Subsequent to cooling, the toner composition is subjected to grinding utilizing, for example, an AFG (Alpine fluidized bed grinder) for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter. Thereafter, the additive can be mixed with the toner.

Illustrative examples of suitable toner resins selected for the toner, developer compositions and processes of the present invention include thermoplastics such as polyamides, polyolefins, styrene acrylates, styrene methacrylates, styrene butadienes, crosslinked styrenes, polyesters including extruded crosslinked polyesters, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like. Examples of specific resins include styrene butadiene copolymers with a styrene content of from about 70 to about 95 weight percent; the esterification products of a dicarboxylic acid and a diol comprising a diphenol as illustrated in U.S. Pat. No. 3,590,000, the disclosure of which is totally incorporated herein by reference. Other specific toner resins include styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethyl terephthalate, 1,3-butanediol, 1,2-propanediol, and pentaerythritol, styrene acrylates, and mixtures thereof. Also, polyolefins with a molecular weight $M_w$ of from about 1,000 to about 10,000, such as polyethylene, polypropylene, and paraffin polyolefins, can be included in, or on the toner compositions as fuser roll release agents.

Numerous well known suitable pigments or dyes can be selected as the colorant for the toner particles including, for example, carbon black, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected providing the objectives of the present invention are achieved.

The toner surface additive can be a metal oxide such as aluminum oxides, cerium oxides, titanium dioxides, silicon oxides, especially fumed silicas, and the like. Titanium dioxide is preferred and is present in the amounts indicated herein, and wherein the second toner contains a smaller amount of the titanium dioxide than the first toner, for example about 0.25 weight percent less.

There can also be blended with the toner compositions of the present invention external additive particles including flow aid additives, which additives are usually present on the surface thereof. Examples of these additives include fumed silicas such as AEROSIL®, metal salts and metal salts of fatty acids inclusive of zinc stearate, and the like, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

Also, there can be included in the toner compositions low molecular weight polyolefins, such as polypropylenes, polyethylenes, or mixtures thereof, for example from 10 to 90 and 90 to 10 of the first and second polyolefins, respectively, commercially available from Allied Chemical and Petrolite Corporation, EPOLENE N-15™ commercially available from Eastman Chemical Products, Inc., VISCOL 550-P™, a low weight average molecular weight polypropylene available from Sanyo Kasei K. K., 800P and P200 polyolefins from Mitsui Chemical Corporation, and the like. The commercially available polyethylenes selected have a weight average molecular weight of from about 1,000 to about 1,500, while the commercially available polypropylenes utilized for the toner compositions of the present invention are believed to have a weight average molecular weight of from about 4,000 to about 5,000. Many of the polyethylene and polypropylene compositions useful in the present invention are illustrated in British Patent No. 1,442,835, the disclosure of which is totally incorporated herein by reference.

Known charge additives can be selected for the toner in effective amounts, such as from about 0.5 to about 3 weight percent, examples of the additives including those as illustrated in the patents mentioned herein, P51, available from Orient Chemicals of Japan, and the like.

For the formulation of developer compositions, there are mixed with the toner particles carrier components, particularly those that are capable of triboelectrically assuming an opposite polarity to that of the toner composition. Accordingly, the carrier particles of the present invention can be selected to be of a negative polarity enabling the toner particles, which are positively charged, to adhere to and surround the carrier particles. Illustrative examples of carrier particles include iron powder, steel, nickel, iron, ferrites, including copper zinc ferrites, magnetites, which are preferred, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,935,326 and 4,937,166, the disclosures of which are totally incorporated herein by reference, including, for example, KYNAR® and polymethylmethacrylate mixtures. Coating weights can vary as indicated herein; generally, however, from about 0.3 to about 2 and preferably from about 0.5 to about 1.5 weight percent coating weight is selected. Carrier coatings with a conductive component, such as carbon black, in an amount of from about 20 to about 40 percent can also be selected.

Furthermore, the diameter of the carrier particles, preferably spherical in shape, is generally from about 3 microns to about 300 and preferably from about 20 to about 90 microns thereby permitting them to possess sufficient density and inertia to avoid adherence to the electrostatic images during the development process. The carrier component can be mixed with the toner composition in various suitable combinations, such as about 1 to 10 parts per toner to about 100 parts to about 200 parts by weight of carrier.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The following Examples are being supplied to further define various species of the present invention, it being noted that these Examples are intended to illustrate and not limit the scope of the present invention. Parts and percentages are by weight unless otherwise indicated.

EXAMPLE I

There was selected a toner with 83.2 percent of PSB 2733 styrene n-butylacrylate, 2 percent of a styrene ethylene butylene compatibilizer, 0.8 percent of the charge additive P51, a chromium quaternary ammonium salt available from Orient Chemicals, 6 percent of P200 polyethylene, 2 percent of polypropylene, VISCOL 660P™ available from Sanyo Chemicals, and 6 percent of REGAL 330® furnace carbon black with surface additive concentration of 1.75 percent of titanium dioxide combined with a carrier comprised of a 65 μm magnetite core, powder coated at 0.8 percent with polyvinylidene fluoride KYNAR® and polymethylmethacrylate (PMMA) mixture at 55/45 percent ratio. When the above toner was blended with the above carrier in a Lodige blender at 8 percent toner concentration by weight, a toner triboelectric response of 16 μc/gram ($A_t$=184) was observed. When generating copies in a Xerox Corporation 5614 copier with consumption toner with 83.2 percent of PSB 2733 styrene n-butylacrylate, 2 percent of styrene ethylene butylene compatibilizer, 0.8 percent of P51 quaternary ammonium salt, 6 percent of P200 polyethylene, 2 percent of the above polypropylene, and 6 percent of REGAL 330® furnace carbon black with a surface additive concentration of 1.75 percent of titanium dioxide, there was a toner concentration drop to 6.5 percent and the toner tribo increase was about 8 μc/gram or an $A_t$ of about 240 percent 12c/gram. Initial time equals zero solid area copy quality performance was 1.35 units with undetectable background contamination. After 4,000 copies in a Xerox Corporation 5614 copier, toner consumption yield was acceptable, that is greater than 4,000 copies per 187 grams with solid area copy quality performance being greater than 1.30 units.

EXAMPLE II

There was prepared a toner with 83.2 percent of PSB 2733 styrene n-butylacrylate, 2 percent of styrene ethylene butylene compatibilizer, 0.8 percent of P51 quaternary ammonium salt, 6 percent of P200 polyethylene, 2 percent of the above Example I polypropylene, and 6 percent of REGAL 330® furnace carbon black with a surface additive concentration of 1.75 percent of titanium dioxide, and this toner was mixed or combined with a carrier, a 65 μm magnetite core, powder coated at 0.8 percent with a KYNAR®, a polyvinylidene fluoride, and polymethylmethacrylate (PMMA) mixture at 55/45 percent ratio. When the above toner and carrier (developer) were blended in a Lodige blender at 8 percent toner concentration by weight, a triboelectric response of 16 μc/gram ($A_t$=184) was measured. When making copies in a Xerox Corporation 5614 copier with consumption replenisher of a toner and carrier mixture at 4 parts toner to 1 part carrier (65 μm magnetite core, powder coated at 0.8 percent with the above carrier coating mixture at 55/45 percent ratio), and wherein the toner comprises 83.2 percent of PSB 2733 styrene n-butylacrylate, 2 percent of styrene ethylene butylene compatibilizer, 0.8 percent of P51 quaternary ammonium salt, 6 percent of P200 polyethylene, 2 percent of polypropylene, and 6 percent of REGAL 330® furnace carbon black with a surface additive concentration of 1.75 percent of titanium dioxide, there was a toner concentration drop to 6.5 percent, the toner tribo increase was about 7 μc/gram, and the $A_t$ was of about 230 percent prig. Initial time equals zero solid area copy quality performance was 1.35 units with undetectable background contamination. After 4,000 copies,in a Xerox Corporation 5614 copier, toner consumption yield was acceptable, >4000 copies per 187 grams, with solid area copy quality performance greater than 1.30 units.

EXAMPLE III

There was selected a toner with 83.2 percent of PSB 2733 styrene n-butylacrylate, 2 percent of styrene ethylene butylene compatibilizer, 0.8 percent of P51 quaternary ammonium salt, 6 percent of P200 polyethylene, 2 percent of the Example I polypropylene, and 6 percent of REGAL 330® furnace carbon black with a surface additive concentration of 2.25 percent of titanium dioxide, combined with a carrier, a 65 μm magnetite core, powder coated at 0.8 percent with a KYNAR® and PMMA mixture at 55/45 percent ratio. When the above toner was blended with the carrier of Example II at 8 percent toner concentration by weight, a triboelectric response of 9 μc/gram ($A_t$=104) was measured. When making copies in a Xerox Corporation 5614 copier with consumption toner with 83.2 percent of PSB 2733 styrene n-butylacrylate, 2 percent of styrene ethylene butylene compatibilizer, 0.8 percent of P51 quaternary ammonium salt, 6 percent of P200 polyethylene, 2 percent of polypropylene, and 6 percent of REGAL 330® furnace carbon black with a surface additive concentration of 1.75 percent of titanium dioxide, the tribo increase was about 15 μc/gram, the $A_t$ was about 240 percent μc/gram, and the toner concentration dropped to 6.5 percent. Initial time equals zero solid area copy quality performance was 1.35 units with undetectable background contamination. After 4,000 copies in a Xerox Corporation 5614 copier, toner consumption yield was acceptable, about 4,000 copies per 187 grams, with solid area copy quality performance greater than 1.30 units.

EXAMPLE IV

There was selected a toner with 83.2 percent of PSB 2733 styrene n-butylacrylate, 2 percent of styrene ethylene butylene compatibilizer, 0.8 percent of P51 quaternary ammonium salt, 6 percent of P200 polyethylene, 2 percent of polypropylene, and 6 percent of REGAL 330® furnace carbon black with surface additive concentration of 2.25 percent of titanium dioxide combined with a carrier, of a 65 μm magnetite core, powder coated at 0.8 percent with KYNAR® and PMMA mixture at 55/45 percent ratio. When the above toner was blended at 8 percent toner concentration by weight, a triboelectric response of 16 μc/gram ($A_t$=184) was observed. When making copies in a Xerox Corporation 5614 copier with consumption replenisher, toner and carrier mixture at 4 parts toner to 1 part carrier (65 μm magnetite core, powder coated at 0.8 percent with KYNAR® and PMMA mixture at 55/45 percent ratio) with 83.2 percent of PSB 2733 styrene n-butylacrylate, 2 percent of styrene ethylene butylene compatibilizer, 0.8 percent of P51 of the charge additive quaternary ammonium salt, 6 percent of P200 polyethylene, 2 percent of polypropylene, and 6 percent of REGAL 330® furnace carbon black with surface additive concentration of 1.75 percent of titanium dioxide, the toner concentration dropped to 6.5 percent, the tribo rise was about 14 μc/gram, and the $A_t$ was about 230 percent μc/gram. Initial time equals zero solid area copy quality performance was 1.35 units with undetectable background contamination. After 4,000 copies in a Xerox Corporation 5614 copier, toner consumption yield was acceptable, >4,000 copies per 187 grams, with solid area copy quality performance being greater than 1.30 units.

Other modifications of the present invention may occur to those skilled in the art subsequent to a review of the present application, and these modifications, including equivalents thereof, are intended to be included within the scope of the present invention.

What is claimed is:

1. A process for the preparation of developer compositions comprising providing a first developer comprised of carrier and first toner comprised of resin, pigment, polyolefin, compatibilizer, charge control agent, and metal oxide surface additive, and adding thereto a second replenisher comprised of carrier, and second toner comprised of resin, pigment, polyolefin, compatibilizer, charge control agent, and metal oxide surface additive, and wherein the metal oxide surface additive of the second toner is present in a lesser amount than the metal oxide surface additive of the first toner.

2. A process for the preparation of developer compositions comprising providing a developer comprised of carrier and a first toner comprised of resin, pigment, polyolefin, wax compatibilizer, charge control agent, and metal oxide surface additive, and adding thereto a second replenisher comprised of carrier, and second toner comprised of resin, pigment, polyolefin, compatibilizer charge control agent, and metal oxide surface additive, and wherein the metal oxide surface additive for the second toner is present in an amount of 0.1 to about 1.5 weight percent lower than the metal oxide surface additive of the first toner.

3. A process in accordance with claim 1 wherein the surface additive for the first and second toners is titanium dioxide.

4. A process in accordance with claim 2 wherein the surface additive for the first and second toners is titanium dioxide.

5. A process in accordance with claim 1 wherein the surface additive for the first toner is present in an amount of from about 1.0 to about 5.0 weight percent.

6. A process in accordance with claim 5 wherein the surface additive for the second toner is present in an amount of from about 0.5 to about 4.0 weight percent.

7. A process in accordance with claim 6 wherein the surface additive for the first and second toner is titanium dioxide.

8. A process in accordance with claim 1 wherein the second toner is added continuously to a xerographic imaging apparatus to maintain developed image density.

9. A process in accordance with claim 1 with a developer $A_t$ that increases after the addition of the second toner.

10. A process in accordance with claim 2 with a developer $A_t$ that increases after the addition of the second toner.

11. A process in accordance with claim 2 with a developer $A_t$ that increases by about 5 to about 100 $A_t$ units.

12. A process in accordance with claim 2 wherein the developer $A_t$ increases from about 120 to about 200 $A_t$ units to about 125 to 250 $A_t$ units at a toner concentration of from about 5 to about 10 percent.

13. A process in accordance with claim 2 with a developer triboelectric charge that increases after the addition of the second replenisher developer.

14. A process in accordance with claim 1 with a toner triboelectric charge that increases from about 10 to about 15 microcoulombs per gram, to about 14 to about 23 microcoulombs per gram after the addition of the second replenisher developer.

15. A process in accordance with claim 2 wherein the first toner triboelectric charge that increases from about 12 to about 18 microcoulombs per gram after the addition of the second replenisher toner.

16. A process in accordance with claim 2 wherein the charge additive is present in an amount of from about 0.05 to about 5 weight percent in the first and second toner.

17. A process in accordance with claim 2 wherein the resin is styrene polymers, polyesters, or mixtures thereof.

18. A process in accordance with claim 2 wherein the resin is styrene acrylates, styrene methacrylates, or styrene butadienes.

19. A process in accordance with claim 2 wherein the first and second toner further contain as external additives metal salts of a fatty acid, colloidal silicas, or mixtures thereof.

20. A process in accordance with claim 1 wherein the polyolefin is of a weight average molecular weight of from about 1,000 to about 20,000, and which polyolefin is present in an amount of from about 1 to about 10 weight percent.

21. A process in accordance with claim 20 wherein the polyolefin is selected from the group consisting of polypropylene, polyethylene, and mixtures thereof, and which mixtures contain from about 10 to about 90 weight percent of polypropylene, and from about 10 to about 90 weight percent of polyethylene.

22. A process in accordance with claim 1 wherein the carrier is comprised of a core with a coating thereover.

23. A process in accordance with claim 1 wherein the carrier is comprised of a core with a first and second coating thereover, and wherein said first and second coatings are not in close proximity in the triboelectric series.

24. A process in accordance with claim 23 wherein the core is comprised of magnetite, the first coating is polyvinylidene fluoride, and the second coating is polymethylmethacrylate.

* * * * *